US009677757B2

(12) United States Patent
Ke

(10) Patent No.: US 9,677,757 B2
(45) Date of Patent: Jun. 13, 2017

(54) AUTOMATIC WATER-ADDING VAPORIZATION POT

(71) Applicant: NINGBO XINLE SMALL DOMESTIC APPLIANCE CO., LTD, Ningbo, Zhejiang (CN)

(72) Inventor: Yu Ke, Zhejiang (CN)

(73) Assignee: NINGBO XINLE SMALL DOMESTIC APPLIANCE CO., LTD., Zhejiang (CN)

( * ) Notice: Subject to any disclaimer, the term of this patent is extended or adjusted under 35 U.S.C. 154(b) by 255 days.

(21) Appl. No.: 14/422,659

(22) PCT Filed: Aug. 30, 2013

(86) PCT No.: PCT/CN2013/001024
§ 371 (c)(1),
(2) Date: Feb. 19, 2015

(87) PCT Pub. No.: WO2014/032400
PCT Pub. Date: Mar. 6, 2014

(65) Prior Publication Data

US 2015/0233573 A1 Aug. 20, 2015

(30) Foreign Application Priority Data

Aug. 31, 2012 (CN) ..... 2012 1 0318454

(51) Int. Cl.
*F24H 1/18* (2006.01)
*F22B 1/28* (2006.01)
*F22D 5/26* (2006.01)

(52) U.S. Cl.
CPC ..... *F22B 1/285* (2013.01); *F22D 5/26* (2013.01)

(58) Field of Classification Search
None
See application file for complete search history.

(56) References Cited

U.S. PATENT DOCUMENTS 2,437,963 A * 3/1948 Langmuir ..... B01F 3/04014 159/900
2,561,932 A * 7/1951 Landgraf ..... H05B 3/80 119/73

(Continued)

FOREIGN PATENT DOCUMENTS

CN 2531178 1/2003
CN 101278794 10/2008

(Continued)

OTHER PUBLICATIONS

International Search Report of International Application No. PCT/CN2013/001024 with English translation, mailed Dec. 12, 2013, 10 pages.

*Primary Examiner* — Thor Campbell
(74) *Attorney, Agent, or Firm* — Young Basile Hanlon & MacFarlane, P.C.

(57) ABSTRACT

An automatic water-adding vaporization including a pot body main body, a heat-generating component installed on the pot body main body, a water pump connected to the pot body main body, a control circuit for controlling the water pump, a temperature acquisition board and a water-depletion-and temperature-sensing element installed on the temperature acquisition board. One end of the temperature acquisition board is either connected to the heat-generating component or to a position of the pot body main body in proximity to the heat-generating component. The remaining parts of the temperature acquisition board are away from the pot body main body. The water-depletion- and temperature-sensing element is installed at a position on the temperature acquisition board away from the pot body main body. The water-depletion- and temperature-sensing element is connected to the control circuit.

14 Claims, 7 Drawing Sheets

(56) References Cited

U.S. PATENT DOCUMENTS 2,686,863 A * 8/1954 Chandler ..... F24H 1/102 122/33
2,785,271 A * 3/1957 Baly ..... F22B 1/284 392/400
4,000,396 A * 12/1976 Abel, Jr. ..... A47J 31/106 222/146.5
4,460,819 A * 7/1984 Eugster ..... F24H 1/142 392/467
4,634,838 A * 1/1987 Berz ..... A47J 31/0576 222/146.5
4,668,854 A * 5/1987 Swan ..... F24F 6/18 122/40
4,835,366 A * 5/1989 Owen ..... H05B 3/80 119/73
4,881,493 A * 11/1989 Riba ..... F22B 1/284 392/400
5,150,448 A * 9/1992 Salomon ..... F24H 1/142 392/397
5,367,607 A * 11/1994 Hufnagl ..... A47J 31/36 392/397
5,459,812 A * 10/1995 Taylor ..... H05B 3/82 392/498
5,651,905 A * 7/1997 Thies ..... A47J 31/053 219/438
5,881,207 A * 3/1999 DeBourg ..... F22B 1/285 340/618
5,933,575 A * 8/1999 Sanders ..... F24H 1/0081 392/497
6,148,144 A * 11/2000 Milanese ..... A47L 11/34 15/320
6,243,535 B1 * 6/2001 Bochud ..... F22B 1/285 392/447
6,915,070 B1 * 7/2005 Lee ..... F24H 1/165 392/465
7,509,034 B2 * 3/2009 Kadoma ..... F22B 1/285 392/386
7,813,628 B2 * 10/2010 Haan ..... F22B 1/288 392/397
7,920,778 B2 * 4/2011 Quah ..... D06F 75/12 392/394
8,146,275 B2 * 4/2012 Lee ..... D06F 75/12 38/77.6
8,616,157 B2 * 12/2013 Xiao ..... F22B 1/285 122/4 A
2003/0142965 A1 * 7/2003 Tsen ..... A47J 37/0704 392/397
2006/0291828 A1 * 12/2006 Kadoma ..... F22B 1/285 392/404
2008/0247740 A1 * 10/2008 Rijskamp ..... A47J 31/54 392/451
2010/0011629 A1 * 1/2010 Pieters ..... D06F 75/12 38/77.6
2010/0021146 A1 * 1/2010 Murai ..... A21B 3/04 392/394
2010/0116812 A1 * 5/2010 Watson ..... F24H 1/202 219/481
2011/0058798 A1 * 3/2011 Garvey ..... A47J 27/2105 392/444
2013/0055902 A1 * 3/2013 Berto ..... A47J 31/542 99/281
2015/0233572 A1 * 8/2015 Shibuya ..... F22B 1/28 219/401
2015/0233573 A1 * 8/2015 Ke ..... F22D 5/26 392/402
2016/0161108 A1 * 6/2016 Chua ..... D06F 75/18 392/399

FOREIGN PATENT DOCUMENTS

| | | |
|---|---|---|
| CN | 201184587 | 1/2009 |
| CN | 201473803 | 5/2010 |
| CN | 101799153 | 8/2010 |
| CN | 101925206 | 12/2010 |
| CN | 202298269 | 7/2012 |
| CN | 202835311 | 3/2013 |
| CN | 202835312 | 3/2013 |
| EP | 0843039 | 5/1998 |
| FR | 2755706 | 5/1998 |

* cited by examiner

AUTOMATIC WATER-ADDING VAPORIZATION POT

CROSS-REFERENCE TO RELATED APPLICATIONS

This application is the national stage of International Application No. PCT/CN2013/001024, which was filed on Aug. 30, 2013, which claims the benefit of Chinese Patent Application No. 201210318454.4, which was filed on Aug. 31, 2012, both of which are incorporated herein by reference.

FIELD

The present disclosure relates to a vaporization pot, and more particularly to an automatic water-adding vaporization pot.

BACKGROUND

For the automatic water-adding vaporization pot in the related art, for example, the French Patent FR2755706A1 published on May 15, 1998 discloses an automatic water-adding steam iron, in which the internal temperature of the pot body is detected by the temperature controller disposed at the outer surface of the pot body, then by continuously sampling values, the water level in the pot body is obtained based on an algorithm, so that the water is added to the pot body under the control of the water pump. This control method needs a complicated control circuit for calculating, and the control is not exact because of the influences of the mounting location of the temperature controller outside of the pot body and the environment. Moreover, this control method is high in cost.

SUMMARY

Technical problems to be solved by the present disclosure include providing an automatic water-adding vaporization pot with simple structure and low cost.

According to embodiments of the present disclosure, an automatic water-adding vaporization pot is provided, comprising a pot body, a heating component mounted on the pot body, a water pump connected with the pot body, and a control circuit for controlling the water pump. The automatic water-adding vaporization pot further comprises: a first temperature acquisition board and a water-shortage and temperature sensing element mounted on the first temperature acquisition board, one end of the first temperature acquisition board is connected with the heating component or to a position of the pot body in proximity to the heating component, remaining parts of the first temperature acquisition board are away from the pot body, the water-shortage and temperature sensing element is mounted at a position of the first temperature acquisition board away from the pot body, and the water-shortage and temperature sensing element is connected with the control circuit.

In some embodiments, a running time of the water pump is depended on a heat transfer rate and a heat capacity of the first temperature acquisition board.

In some embodiments, the heat transfer rate and the heat capacity of the first temperature acquisition board are depended on a mounting position, a volume and a shape of the first temperature acquisition board.

In some embodiments, the first temperature acquisition board and the heating component are formed integrally.

In some embodiments, the heating component is provided with a heating tube, and the one end of the first temperature acquisition board is located at the heating tube.

In some embodiments, the one end of the first temperature acquisition board is bent and then connected with the heating component, and an interval between the remaining part of the first temperature acquisition board and the pot body ranges from 0.5 mm to 20 mm.

In some embodiments, the first temperature acquisition board and the heating component are connected together by welding or bolt connection.

In some embodiments, a mounting hole is formed in the part of the first temperature acquisition board away from the pot body, a support member is mounted in the mounting hole, and a bottom of the support member is supported on the pot body.

In some embodiments, a second temperature acquisition board is further provided, and a temperature sensor for controlling a steam pressure is mounted on the second temperature acquisition board.

In some embodiments, the first temperature acquisition board is further provided with a temperature sensor for controlling a steam pressure.

In some embodiments, an on-off switch is connected into a power supply circuit of the heating component, and the on-off switch and the water-shortage and temperature sensing element are linked, or the water-shortage and temperature sensing element controls the on-off switch on or off.

In some embodiments, a plurality of connection elements are disposed at a bottom of the pot body, and the heating component is provided with through holes through which the connection elements penetrate, so as to be fixed via the connection elements and brazed to the bottom of the pot body.

In some embodiments, a reinforcing column is disposed within the pot body and has one end connected with an inner surface of a bottom of the pot body and the other end connected with a top of the pot body.

In some embodiments, a protection circuit for dry burning prevention is further provided, the protection circuit for dry burning prevention comprises a PTC thermal protector for sensing a dry burning temperature, and the PTC thermal protector is connected with a heating control circuit of the heating component.

In some embodiments, the first temperature acquisition board is formed by middle part of the heating component which is protruded outward, and the temperature acquisition board is connected with the heating component via a connecting leg.

By providing the first temperature acquisition board, the water-shortage and temperature sensing element is mounted on the first temperature acquisition board. When a water quantity is decreased, an amount of heat transferred from the heating component to the temperature acquisition board is increased, and thus the temperature acquisition board can be quickly heated up. The water-shortage and temperature sensing element controls the water pump to be operated via the control circuit, and once the pot body is filled with water, a temperature of the pot body is decreased quickly. Because of the heat capacity of the first temperature acquisition board and a temperature compensation effect of the heating component, however, the decreased internal temperature of the pot body influences the temperature of the first temperature acquisition board with a delay, and a duration of the delay equals to a duration of adding water of the water pump. Therefore, with a delay effect of the temperature acquisition board, functions of high-low water level detection and automatic water-adding may be achieved by one temperature sensing element. The automatic water-adding vaporization pot is simple in structure and low in cost.

DETAILED DESCRIPTION

Figure 1:
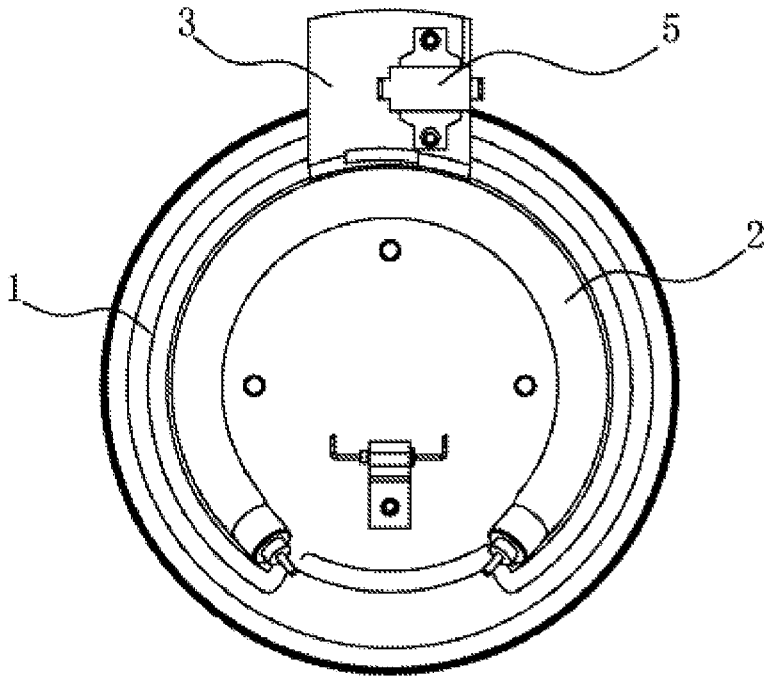
FIG. 1 is a plan view of an automatic water-adding vaporization pot according to a first embodiment of the present disclosure.
Figure 2:
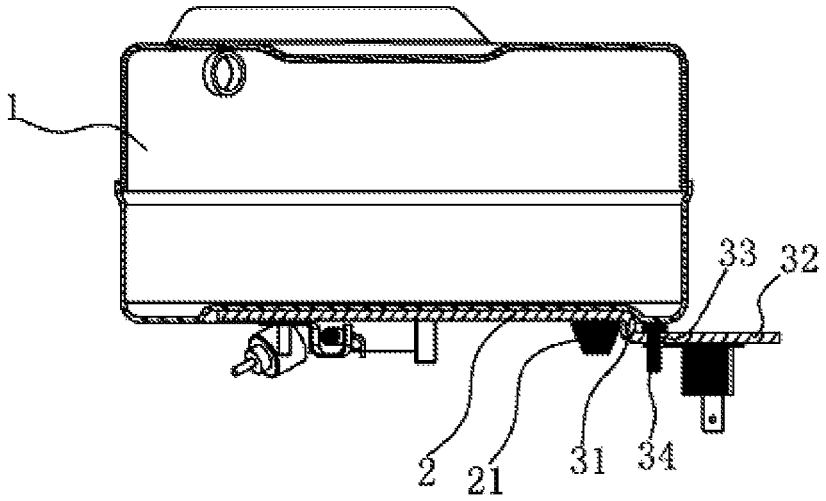
FIG. 2 is a cross-sectional view of the automatic water-adding vaporization pot as shown in FIG. 1.
Figure 3:
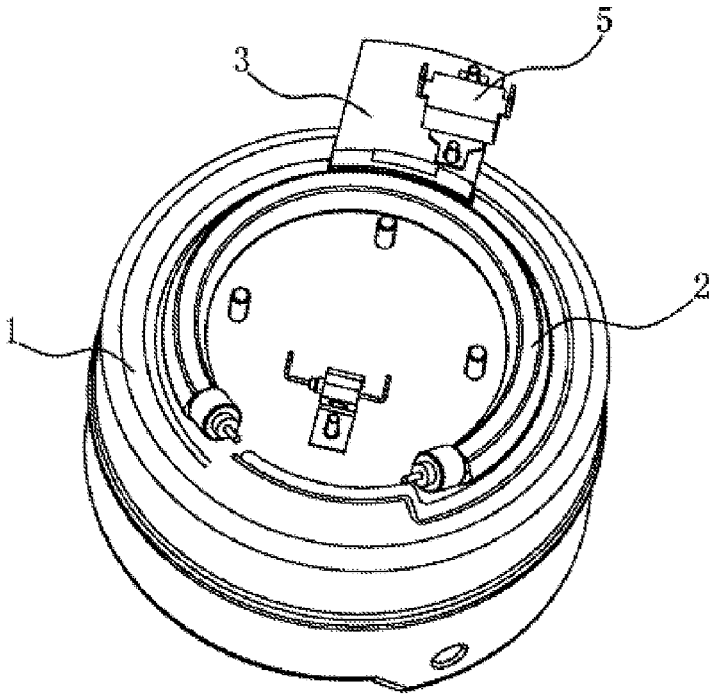
FIG. 3 is a perspective view of the automatic water-adding vaporization pot as shown in FIG. 1.

Referring to FIGS. 1-3, an automatic water-adding vaporization pot of a first embodiment of the present disclosure provided includes a pot body 1, a heating component 2 mounted on the pot body 1, a water pump connected with the pot body 1, a control circuit for controlling the water pump, a first temperature acquisition board 3 and a water-shortage and temperature sensing element 5 mounted on the first temperature acquisition board 3.

More specifically, one end 31 of the first temperature acquisition board 3 is connected with the heating component 2, the remaining parts 32 of the temperature acquisition board 3 are away from the pot body 1, so that temperatures of the temperature acquisition board 3 and the pot body 1 are not synchronous. For instance, when the temperature of the pot body 1 is decreased rapidly, the temperature of the temperature acquisition board 3 may be decreased later or far more slowly than the decreased temperature of the pot body 1. The water-shortage and temperature sensing element 5 is mounted at a position of the first temperature acquisition board 3 away from the pot body 1, and the water-shortage and temperature sensing element 5 is connected with the control circuit.

A conventional temperature controller is generally directly mounted on the pot body, in other words, the temperature controller can detect a temperature of the pot body directly. When the pot body is filled with water, a temperature detected by the temperature controller is decreased quickly, and thus the temperature controller can detect the decreased temperature immediately (i.e. there is no delay for detecting the decreased temperature by the temperature controller), a duration of adding water to the water pump cannot be met. A conventional solution is to detect a water level with an electric contact due to an influence of hard water, however, a detection accuracy is poor.

In the embodiment of the present disclosure, the first temperature acquisition board 3 plays a role of controlling a temperature-sensing. When a water quantity is decreased, an amount of heat transferred from the heating component 2 to the first temperature acquisition board 3 is increased, and thus the first temperature acquisition board 3 can be quickly heated up. The water-shortage and temperature sensing element 5 detects a change of the temperature and controls the water pump to fill water into the pot body 1. Once the pot body 1 is filled with water, the temperature of the pot body 1 is decreased quickly. Due to a heat capacity of the first temperature acquisition board 3 and a temperature compensation effect of the heating component 2, however, the decreased internal temperature of the pot body 1 influences the temperature of the first temperature acquisition board 3 with a delay, i.e. the first temperature acquisition board 3 may not be quickly cooled down, such that a dropped temperature of the first temperature acquisition board 3 is detected by the water-shortage and temperature sensing element 5, after the temperature of the pot body 1 has been decreased a while. A duration of the delay equals to the duration of adding water of the water pump. The duration of adding water of the water pump can be calculated according to a volume of the pot body 1, and a mounting location of the water-shortage and temperature sensing element 5 on the first temperature acquisition board 3 is determined accordingly. The water-shortage and temperature sensing element 5 in the embodiment of the present disclosure is a temperature controller or a temperature sensitive resistor. By providing the water-shortage and temperature sensing element 5 and the first temperature acquisition board 3, a function of continuous automatic water-adding may be achieved without any complicated control calculation, and a cost of the automatic water-adding vaporization pot is reduced.

The solution of the present disclosure is different from the conventional solution such that the internal temperature of the pot body 1 is directly measured by a temperature sensing element 5. In the embodiment of the present disclosure, the first temperature acquisition board 3 is used as a reference for measuring temperature. Such an indirect detection method for detecting temperature has adjustability and is favorable for adjustments of both a reference temperature and a measurement temperature of the temperature sensing element 5, so as to achieve the continuous water-adding. The first temperature acquisition board 3 in the embodiment of the present disclosure plays roles of both transferring and collecting heat. The first temperature acquisition board 3 plays a role of stable calibration for a temperature control element at an initial stage. During ordinary work, the first temperature acquisition board 3 has a stable temperature, which may better meet a requirement of the detection of the temperature sensing element 5.

Referring to FIG. 1, in the embodiment of the present disclosure, a running time of the water pump is depended on a heat transfer rate and a heat capacity of the first temperature acquisition board 3. The heat transfer rate and the heat capacity of the first temperature acquisition board 3 are depended on a mounting position, a volume and a shape of the first temperature acquisition board 3. The running time of the water pump is depended on relative positions between the first temperature acquisition board 3 and an inlet of the pot body 1. The running time of the water pump may be adjusted by adjusting above parameters.

Referring to FIG. 2, in the embodiment of the present disclosure, the first temperature acquisition board 3 and the heating component 2 are formed integrally. The heating component 2 in the embodiment of the present disclosure may be configured a heating plate, and the first temperature acquisition board 3 and the heating plate 2 may adopts a same material. Certainly, for the case of non-integral forming, the first temperature acquisition board 3 may also use other material, such as a metal material or a ceramic material. In the embodiment of the present disclosure, the first temperature acquisition board 3 and the heating plate 2 may be connected together by welding or bolt connection, in which the bolt connection means connecting the first temperature acquisition board 3 and the heating plate 2 by screw or bolt.

Referring to FIG. 1 and FIG. 3, in the embodiment of the present disclosure, the heating plate 2 is provided with a heating tube 21, and the one end of the first temperature acquisition board 3 is located at the heating tube 21, such that the first temperature acquisition board 3 may promptly reflect a temperature change of the of the heating plate 2, thus exactly detecting the change of the temperature.

Referring to FIG. 2, in the embodiment of the present disclosure, the one end 31 of the first temperature acquisition board 3 is bent and then connected with the heating plate 2, and an interval between the remaining part 32 of the first temperature acquisition board 3 and the pot body 1 ranges from 0.5 mm to 20 mm. In this embodiment, the interval is 5 mm. Since there is the above interval between the remaining part 32 of the first temperature acquisition board 3 and the pot body 1, the pot body 1 may not directly contact the temperature sensing element.

Referring to FIG. 1, in the embodiment of the present disclosure, a mounting hole 33 is formed in the part 32 of the first temperature acquisition board 3 away from the pot body 1, a support member 34 is mounted in the mounting hole 33, and a bottom of the support member 34 is supported on the pot body 1. The support member 34 may not only play a role of supporting for the first temperature acquisition board 3 but also be used as a connector for mounting the water-shortage and temperature sensing element 5. It is not easy for a deformation occurring to the remaining part 32 of the first temperature acquisition board 3 away from the pot body 1 because of an existence of the support member 34.

Figure 4:
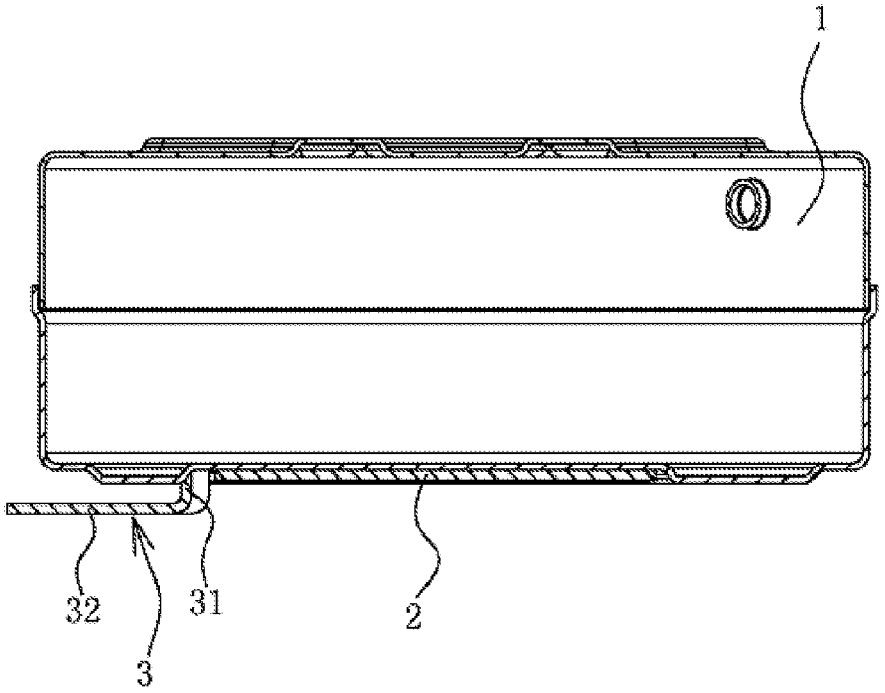
FIG. 4 is a cross-sectional view of an automatic water-adding vaporization pot according to a second embodiment of the present disclosure.

Referring to FIG. 4, differences between a second embodiment of the present disclosure and the above embodiment are that the first temperature acquisition board 3 in the second embodiment is connected to the pot body 1, and a connecting position is in proximity to the heating body 2. Other structures, function and working principle of this embodiment are the same as the above embodiment.

Figure 5:
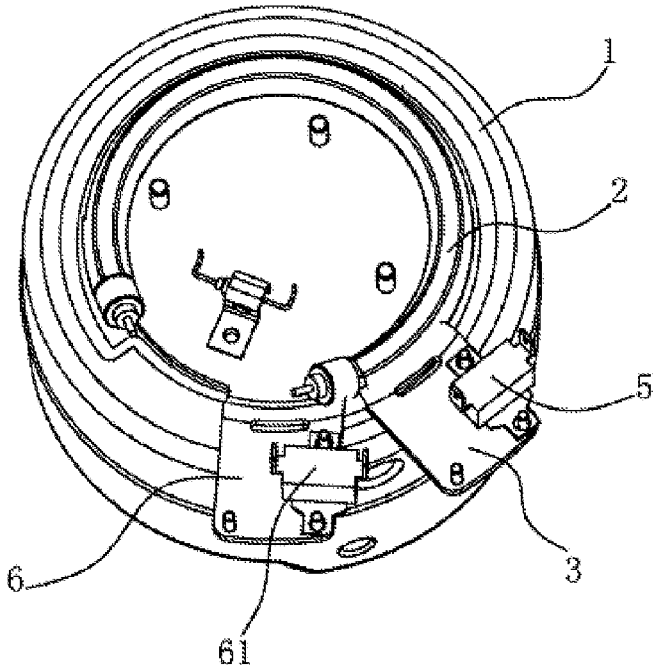
FIG. 5 is a perspective view of an automatic water-adding vaporization pot according to a third embodiment of the present disclosure.

Referring to FIG. 5, in a third embodiment of the present disclosure, a second temperature acquisition board 6 is further provided, and a temperature sensor 61 for controlling a steam pressure is mounted on the second temperature acquisition board 6. Because a temperature of the second temperature acquisition board 6 may exactly reflect the temperature of the heating plate, the temperature sensor 61 may be promptly activated so as to make the steam pressure in the pot body 1 stable. Other structures of this embodiment are identical with the above two embodiments.

In this embodiment, a second water-shortage and temperature sensing element may be also provided on the second temperature acquisition board 6, and the first water-shortage and temperature sensing element 5 and the second water-shortage and temperature sensing element are configured for a high temperature detection and a low temperature detection respectively. A control for automatic water-adding is achieved by calculating a temperature difference or a temperature variation between the two water-shortage and temperature sensing elements.

Figure 6:
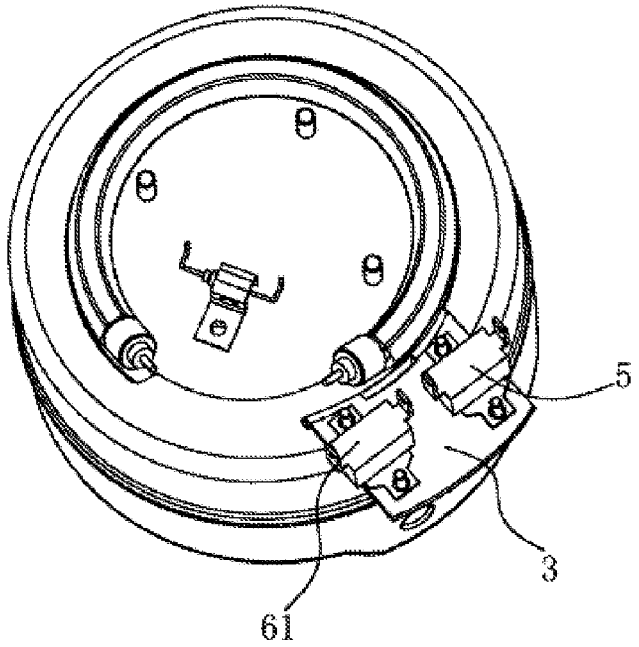
FIG. 6 is a perspective view of an automatic water-adding vaporization pot according to a fourth embodiment of the present disclosure.

Referring to FIG. 6, in a fourth embodiment of the present disclosure, the first temperature acquisition board 3 is provided with the water-shortage and temperature sensing element 5 and a temperature sensor 61 for controlling the steam pressure. Because a temperature of the first temperature acquisition board 3 may exactly reflect the temperature of the heating plate, the temperature sensor 61 may be promptly activated so as to make the steam pressure in the pot body stable. Other structures of this embodiment are identical with the above two embodiments.

Figure 7:
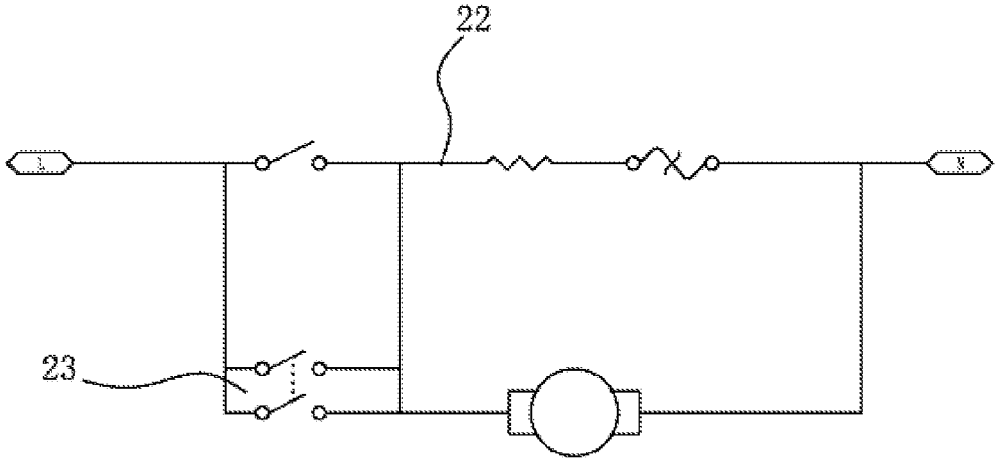
FIG. 7 is a schematic circuit diagram of an automatic water-adding vaporization pot according to a fifth embodiment of the present disclosure.

Referring to FIG. 7, in a fifth embodiment of the present disclosure, other structures are the same as each embodiment described above, except that an on-off switch 23 is connected into a power supply circuit 22 of the heating component 2, and the on-off switch 23 and the water-shortage and temperature sensing element 5 are linked. In this embodiment, the water-shortage and temperature sensing element 5 is a double-throw temperature controller that has two groups of contacts simultaneously being activated, in which one group of contacts controls the running of the water pump and the other group of contacts controls the power supply circuit 22 of the heating component 2 to work. This power supply circuit may enable the heating component 2 to go on working while the water pump is running. In the related art, if the pot body 1 is short of water, the heating component 2 will stop working until the pot body 1 is filled with water. In the present disclosure, the heating component 2 starts to heat while the water pump is working, which not only improve a generating speed of the steam, but also ensure a stability of the steam.

Certainly, other structures may also be applied in the present disclosure to enable the water-shortage and temperature sensing element 5 to control the heating component 2 to work. For example, when two water-shortage and temperature sensing elements are used, a high temperature water-shortage and temperature sensing element is connected into the power supply circuit 22 of the heating component 2. The heating component 2 is connected at the high temperature, and once the temperature is reduced, it switches to an ordinary power supply circuit. Certainly, a controller mode may also be used, such that once a controller receives an activation signal from the water-shortage and temperature sensing element, the controller controls the heating component 2 to work.

Figure 8:
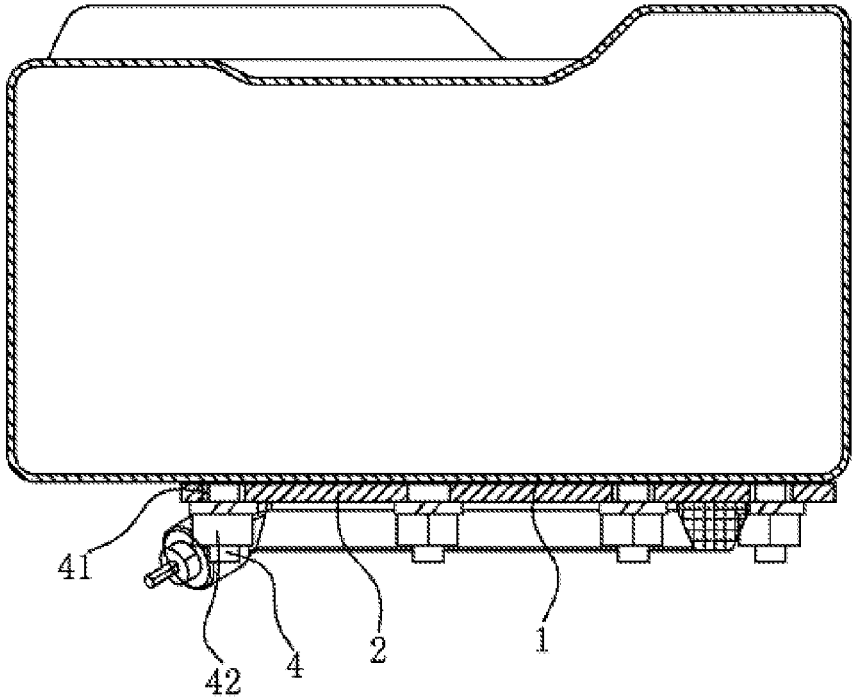
FIG. 8 is a cross-sectional view of an automatic water-adding vaporization pot according to a sixth embodiment of the present disclosure.

Referring to FIG. 8, in a sixth embodiment of the present disclosure, the heating component 2 is brazed to the bottom of the pot body 1. Moreover, in order to further improve a connecting stability between the heating component 2 and the bottom of the pot body 1, a plurality of connection elements 4 are disposed at the bottom of the pot body 1, and the heating component 2 is provided with through holes 41 through which the connection elements 4 penetrate, so that the heating component 2 is fastened to the bottom of the pot body 1 via the connection elements 4. In the embodiment of the present disclosure, by using a combination connecting means of the connection elements 4 and brazing, a slitting or de-soldering caused by a creep between the heating component and the bottom of the pot body 1 due to different coefficients of thermal expansion can be prevented, such that a connection between the heating plate and the pot body 1 is closer, thus improving a thermal conduction efficiency. In the embodiment of the present disclosure, the connection elements 4 are presented at the bottom of the pot body 1, for example, the connection elements 4 may be pre-welded at the bottom of the pot body 1, and the heating component 2 is fixed at the bottom of the pot body 1 by both fastening of the connection elements 4 and brazing during assembling.

Figure 9:
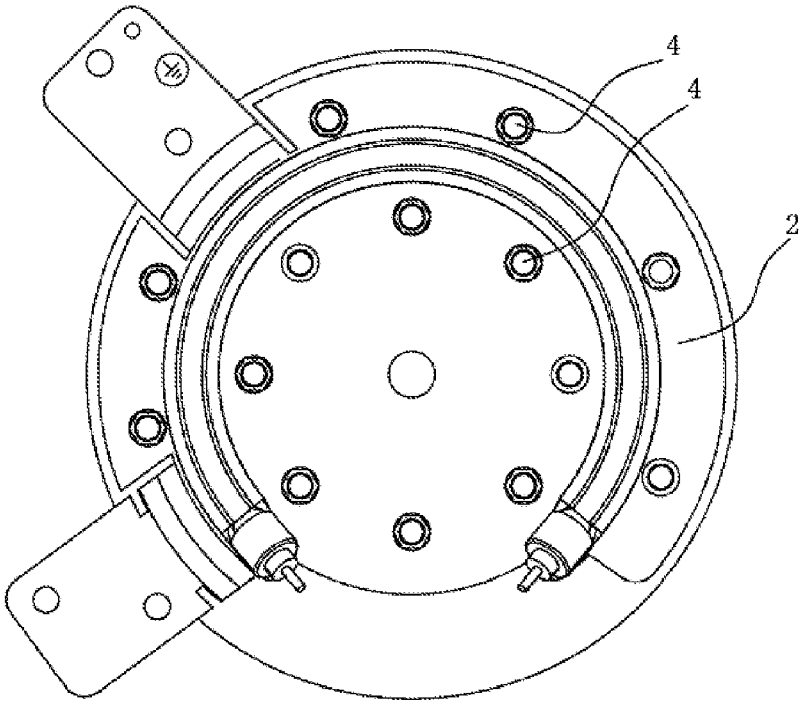
FIG. 9 is a bottom view of the automatic water-adding vaporization pot according to the sixth embodiment of the present disclosure.

Referring to FIG. 8 and FIG. 9, in above embodiment of the present disclosure, the plurality of connection elements 4 are arranged along a circumference or a rectangle, and the number of the connection elements 4 is 4-20. In this embodiment, the plurality of connection elements 4 are arranged along the circumference and the number of the connection elements 4 is 14. In this embodiment, the connection elements 4 are arranged in inner and outer circles, and the heating tube of the heating component 2 is located between the two circles of connection elements 4. The heating component 2 may be better secured without creep by such inner-and-outer-circles structure of the connection elements 4. Certainly, the plurality of connection elements 4 may be also arranged at the bottom of the pot body 1 uniformly in other pattern so as to make the heating component 2 bear uniform force without creep. The connection elements 4 may be configured studs, one end of each connection element 4 is point welded to the bottom of the pot body 1, and the other end of each connection element 4 secures the heating component 2 via a nut 42. The stud and nut are used for securing in this embodiment; each stud is point welded to the bottom of the pot body 1 and secures the heating component 2 via the nut. Certainly, other connection modes may be applied in the present disclosure. For example, the connection elements 4 may also configured rivets, one end of each rivet is point welded to the bottom of the pot body 1, and the other end of each rivet is riveted to the heating component 2. A riveting structure is used in this mode.

In the embodiment of the present disclosure, the connection elements are provided between reinforcing ribs at the bottom of the pot body 1. With an aluminum sheet and a stainless steel for a screw fixing at the connection elements 4 and a brazing solder penetration into the screw fixing, a reinforcing structure is formed at the connection elements 4. Firstly, the reinforcing structure at the connection elements 4 reduces the creep of the aluminum sheet caused by different coefficients of thermal expansion. Secondly, a part of the bottom of the pot body 1 between the reinforcing ribs and the connection elements 4 may keep minimum deformation under a pressure of the pot body 1, and thus the heating tube is disposed at this part more stably, and an edge cracking of the aluminum sheet is reduced.

The structure of this embodiment described above is applicable for each embodiment described above, and remaining structures of this embodiment identical with each embodiment described above will not be described in detail herein.

Figure 10:
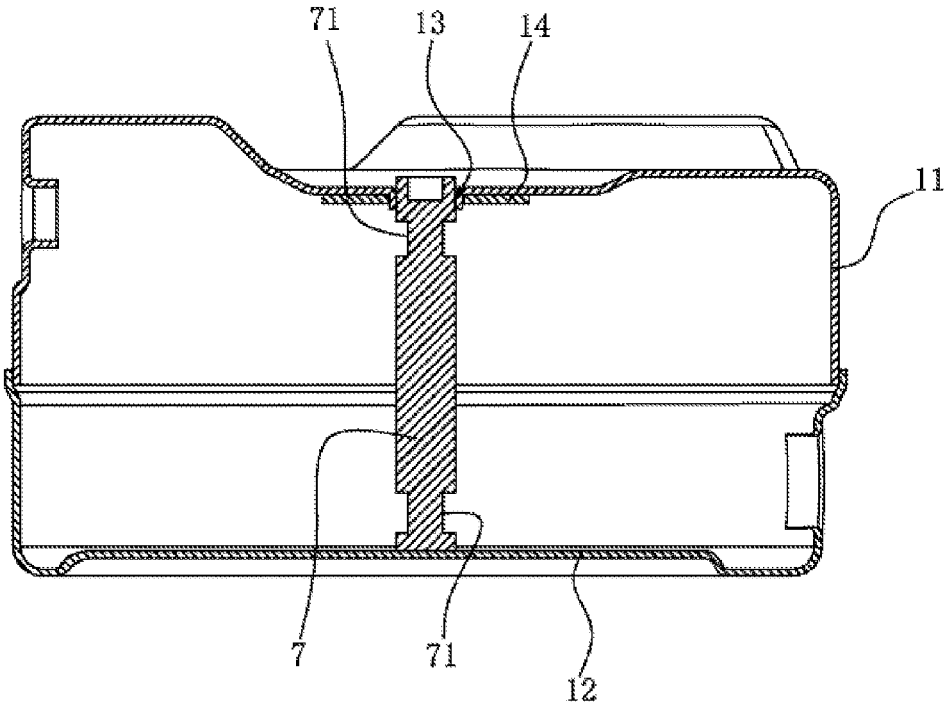
FIG. 10 is a cross-sectional view of an automatic water-adding vaporization pot according to a seventh embodiment of the present disclosure.

Referring to FIG. 10, in a seventh embodiment of the present disclosure, a reinforcing column 7 is disposed within the pot body 1, one end of the reinforcing column 7 is connected with an inner surface of a bottom of the pot body 1, and the other end of the reinforcing column 7 is connected with a top of the pot body 1. By providing the reinforcing column 7 in the embodiment of the present disclosure, a deformation of the pot body is reduced, such that the brazed heating component 2 may not be cracked. The pot body 1 in the embodiment of the present disclosure consists of an upper pot body 11 and a lower pot body 12. A through hole 13 with a flanging is formed inward at a top of the upper pot body 11. A top of the reinforcing column 7 is welded in the through hole 13, and a bottom of the reinforcing column 7 is welded to an inner surface of a bottom of the lower pot body 12. A spacer 14 is further disposed at the through hole 13. The spacer 14 is favorable for the welding of the reinforcing column 7 and plays a role of protection for the upper pot body 11. A groove 71 is formed at the top and bottom of the reinforcing column 7 respectively. The groove 71 is favorable for the welding of the reinforcing column 7. With the groove 71, the heat may be concentrated at a welding part during the welding, thus improving a welding efficiency and reducing a welding time.

The structure of this embodiment described above is applicable for each embodiment described above, and remaining structures of this embodiment identical with each embodiment described above will not be described in detail herein.

Figure 11:
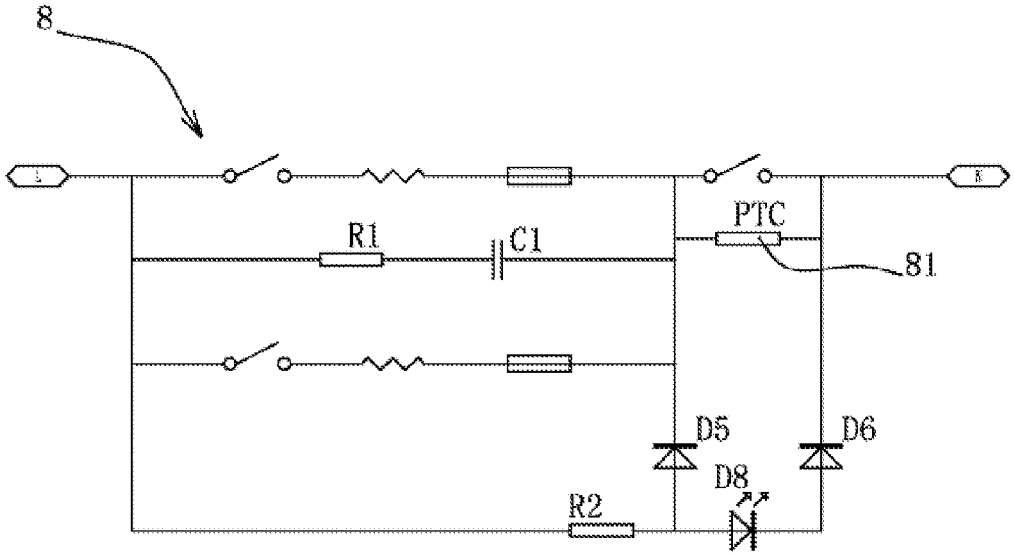
FIG. 11 is a schematic circuit diagram of an automatic water-adding vaporization pot according to an eighth embodiment of the present disclosure.

Referring to FIG. 11, in an eighth embodiment of the present disclosure, a protection circuit 8 for dry burning prevention is further provided. The protection circuit 8 for dry burning prevention comprises a PTC thermal protector 81 for sensing a dry burning temperature, and the PTC thermal protector 81 is connected with a heating control circuit of the heating component 2. In the embodiment of the present disclosure, contacts of the PTC thermal protector are connected in series in the heating control circuit of the heating component 2. When a temperature reaches the dry burning temperature, the PTC thermal protector is activated. In this case, a PTC heating element in the PTC thermal protector is on and heated, thus keeping the contacts of the PTC thermal protector always activated instead of resetting. Such PTC thermal protector may be purchased from a market. In the embodiment of the present disclosure, the PTC thermal protector is provided as a temperature controller for dry burning prevention, such that a heater may be not on and off repeatedly, thus extending service lives of related devices. In the embodiment of the present disclosure, the PTC thermal protector may also be mounted on the first temperature acquisition board 3, such that a dry burning signal can be exactly detected and the protection for the dry burning is timely.

The structure of this embodiment described above is applicable for each embodiment described above, and remaining structures of this embodiment identical with each embodiment described above will not be described in detail herein.

Figure 12:
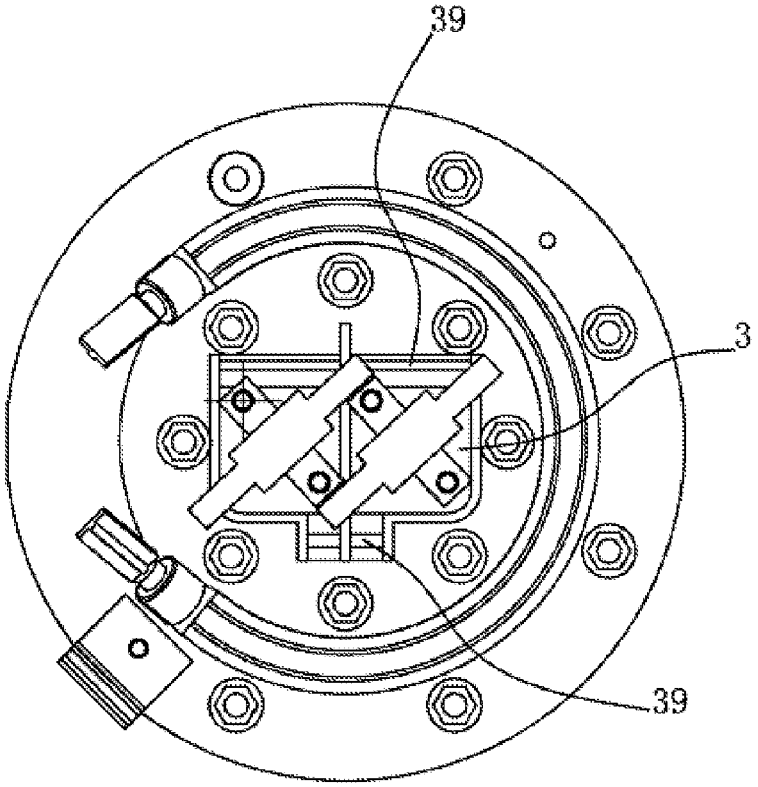
FIG. 12 is a plan view of an automatic water-adding vaporization pot according to a ninth embodiment of the present disclosure.
Figure 13:
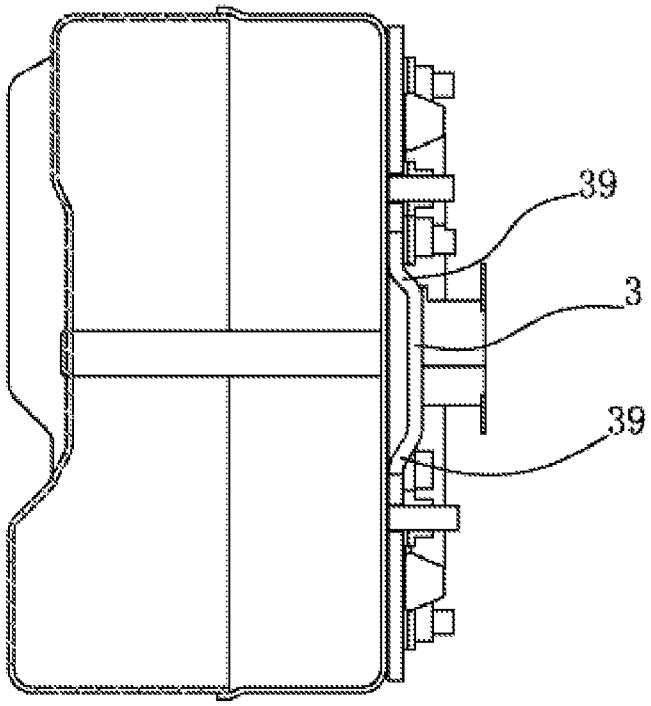
FIG. 13 is a cross-sectional view of the automatic water-adding vaporization pot according to a ninth embodiment of the present disclosure.

Referring to FIG. 12 and FIG. 13, in a ninth embodiment of the present disclosure, the first temperature acquisition board 3 is formed by a middle part of the heating component 2 which is protruded outward, and the first temperature acquisition board 3 is connected with the heating component 2 via a connecting leg 39. In this embodiment, the first temperature acquisition board 3 is formed by protruding the middle part of the heating component 2 outside, such that the first temperature acquisition board 3 is away from the pot body 1 and plays the same role as that in each embodiment described above. By using such structure, an installation of each element is within a projection of the pot body 1, which is convenient for installation. Remaining structures of this embodiment are identical with each embodiment described above.

In this embodiment of the present disclosure, the first temperature acquisition board 3 is connected with the heating component 2 via the connecting leg 39 located at one side. Moreover, the connecting leg 39 is configured for transferring heat. Therefore, a time period for transferring heat may be controlled by adjusting a size of the connecting leg 39. In this embodiment, both sides of the first temperature acquisition board 3 are connected with the heating component 2 via the connecting legs 39, and the remaining parts of the first temperature acquisition board 3 are away from the heating component 2. Certainly, such outward protruding structure may be also replaced by an inward recessing of the pot body 1. A design that the connection elements 4 are arranged in inner-and-outer-circles according to the sixth embodiment is used in this embodiment. Other structures may use a related structure of the embodiments described above or a combination thereof.

What is claimed is:

1. An automatic water-adding vaporization pot, comprising:

a pot body, a heating component mounted on the pot body, a water pump connected with the pot body, and a control circuit for controlling the water pump, a first temperature acquisition board, wherein a mounting hole is formed in the part of the first temperature acquisition board away from the pot body, and wherein a support member is mounted in the mounting hole and has a bottom supported on the pot body, and a water-shortage and temperature sensing element mounted on the first temperature acquisition board, wherein one end of the first temperature acquisition board is connected with the heating component or to a position of the pot body in proximity to the heating body, wherein a remaining part of the first temperature acquisition board is away from the pot body, wherein the water-shortage and temperature sensing element is mounted at a position of the first temperature acquisition board away from the pot body, and wherein the water-shortage and temperature sensing element is connected with the control circuit.

2. The automatic water-adding vaporization pot of claim 1, wherein a running time of the water pump is depended on a heat transfer rate and a heat capacity of the first temperature acquisition board.

3. The automatic water-adding vaporization pot of claim 2, wherein the heat transfer rate and the heat capacity of the first temperature acquisition board are depended on at least one of a mounting position, a volume and a shape of first the temperature acquisition board.

4. The automatic water-adding vaporization pot of claim 1, wherein the first temperature acquisition board and the heating component are formed integrally.

5. The automatic water-adding vaporization pot of claim 1, wherein the heating component is provided with a heating tube, and the one end of the first temperature acquisition board is located at the heating tube.

6. The automatic water-adding vaporization pot of claim 1, wherein the one end of the first temperature acquisition board is bent and then connected with the heating component, and an interval between the remaining part of the first temperature acquisition board and the pot body ranges from 0.5mm to 20mm.

7. The automatic water-adding vaporization pot of claim 1, wherein the first temperature acquisition board and the heating component are connected by welding or bolt connection.

8. The automatic water-adding vaporization pot of claim 1, further comprising a second temperature acquisition board, wherein a temperature sensor for controlling a steam pressure is mounted on the second temperature acquisition board.

9. The automatic water-adding vaporization pot of claim 1, wherein the first temperature acquisition board is further provided with a temperature sensor for controlling a steam pressure.

10. The automatic water-adding vaporization pot of claim 1, wherein an on-off switch is connected with a power supply circuit of the heating component, and wherein the on-off switch and the water-shortage and temperature sensing element are linked.

11. The automatic water-adding vaporization pot of claim 1, wherein a plurality of connection elements is disposed at a bottom of the pot body, and the heating component is provided with through holes penetrated by the connection elements, so as to be fixed via the connection elements and brazed on the bottom of the pot body.

12. The automatic water-adding vaporization pot of claim 1, wherein a reinforcing column is disposed within the pot body, and has one end connected with an inner surface of a bottom of the pot body and the other end connected with a top of the pot body.

13. The automatic water-adding vaporization pot of claim 1, further comprising a protection circuit for dry burning prevention including a PTC thermal protector for sensing a dry burning temperature, wherein the PTC thermal protector is connected with a heating control circuit of the heating component.

14. The automatic water-adding vaporization pot of claim 1, wherein the first temperature acquisition board is formed by a middle part of the heating component protruded outward, and wherein the temperature acquisition board is connected with the heating component via a connecting leg.

* * * * *